US005564230A

United States Patent [19]

Periou

[11] Patent Number: 5,564,230

[45] Date of Patent: Oct. 15, 1996

[54] WINDOW LIFTER DEVICE FOR A MOTOR VEHICLE, EQUIPPED WITH AN ANTI-TRAP SAFETY FEATURE SUITABLE FOR DAMPING OUT AN IMPACT OF THE WINDOW PANE AGAINST AN OBSTACLE

[76] Inventor: Pierre Periou, 15 Bocages Bruns, 95000 Cergy Pontoise, France

[21] Appl. No.: 169,818

[22] Filed: Dec. 17, 1993

[30] Foreign Application Priority Data

Dec. 21, 1992 [FR] France ..... 92 15415

[51] Int. Cl.[6] ..... E05F 15/16

[52] U.S. Cl. ..... 49/349; 49/352

[58] Field of Search ..... 49/349, 350, 351, 49/352, 374, 375, 502

[56] References Cited

U.S. PATENT DOCUMENTS

| | | | |
|---|---|---|---|
| 2,913,920 | 11/1959 | Wise | 49/349 X |
| 2,955,816 | 10/1960 | Wise | 49/349 |
| 3,281,991 | 11/1966 | Colell . | |
| 4,314,692 | 2/1982 | Brauer et al. | 49/349 X |
| 4,706,412 | 11/1987 | Kobrehl . | |
| 4,890,376 | 1/1990 | Boileau | 49/349 X |
| 4,899,608 | 2/1990 | Knappe et al. | 49/349 X |
| 5,040,430 | 8/1991 | Adam et al. | 49/349 X |

FOREIGN PATENT DOCUMENTS

| | | | |
|---|---|---|---|
| 0008247A1 | 2/1980 | European Pat. Off. . | |
| 0107531 | 5/1984 | European Pat. Off. . | |
| 2100148 | 3/1972 | France . | |
| 1263540 | 3/1968 | Germany | 49/349 |
| 2836032A1 | 2/1980 | Germany . | |
| 822658 | 10/1959 | United Kingdom . | |
| 2099897 | 12/1982 | United Kingdom . | |

*Primary Examiner*—Philip C. Kannan

[57] ABSTRACT

The window lifter (1) may, for example, be of the twisted cable type (3) driven by a motorized reduction gear (2) wound around return pulleys (4, 5) and sliding in a guide rail (6); a carriage (8) carrying the window pane (9) is fixed to the strand of the cable passing into the rail (6); damping elements (11) such as flat metal springs, for example, are fixed to the ends of the guide rail (6) and to the door panel (7), which makes it possible to damp out a hard impact against an obstacle encountered by the window pane (9).

19 Claims, 6 Drawing Sheets

WINDOW LIFTER DEVICE FOR A MOTOR VEHICLE, EQUIPPED WITH AN ANTI-TRAP SAFETY FEATURE SUITABLE FOR DAMPING OUT AN IMPACT OF THE WINDOW PANE AGAINST AN OBSTACLE

The subject of the present invention is a window lifter device for a motor vehicle, comprising a motorized reduction gear for driving a kinematic chain at the end of which the window pane is mounted.

It is known, that in general, window lifters are equipped with resilient or flexible elements for the purpose of absorbing kinetic energy when the window lifter comes into abutment, for example as described in EP-A 008,247 (elastic tongues 21, 22).

However, the characteristics of these energy absorbers do not allow a hard impact to be converted into a soft impact.

In effect, it is known that certain standards relating to the safety features of motor vehicle window lifters may require a test with a hard object. This test consists in placing a hard object in the path of the window pane, and in determining whether, after contact of the window pane with the hard object and after the window pane has been relowered, the force to which the object has been subjected has exceeded a certain limit, for example 10 kg. Now, certain safety systems may be subjected to forces which are distinctly higher during tests with the aid of hard objects. This comes from the rigidity and from the momentum of the window lifter system and of the window pane, which momentum is a function of the speed. The greater the speed of the window pane, the greater its momentum.

In theory, a completely rigid system which is brought to rest abruptly by a completely rigid object develops an infinite force on the latter. It is easily understood that if the system triggers on a soft object at a certain value of force it can, if the test is carried out with a rigid object, greatly exceed this force. Momentum, even if small, if the translational speed of the window pane is small, can generate very high forces.

It may therefore prove necessary, in certain cases, to decrease the rigidity of the system and to damp out the impact.

The object of the invention consists precisely in solving this problem satisfactorily, which result cannot be achieved with the kinetic energy absorbing elements mentioned above.

Moreover, documents are known describing elastic elements in the kinematic chain, which elements are adapted to specific functions such as quick fixing (U.S. Pat. No. 4,706,412, FR-2,100,148, U.S. Pat. No. 3,281,991), taking up play (DE-2,836,032). Moreover, FR-A-0,107,531 discloses a window lifter equipped with an end of travel switch spring which is incapable of fulfilling any function other than detecting high end-of-travel forces, which are therefore of the order of 25 to 30 kg, this being by way of a secondary effect.

Finally, GB-A-822,658 relates to a window lifter in which an elastic system has the essential function of electrical switching between electrical contacts 19 and 20. At the end of travel, or in the event of encountering an obstacle, the spring 35 must react only to high forces, namely approximately 20 kg, in order to allow, in normal use, the window pane to return between the weather strips upon closure. In this way, owing to its excessively high stiffness, such a spring cannot fulfil a function of converting a hard impact into a soft impact. What is more, if it is desired to substitute for the spring 35 a spring capable of fulfilling the conversion above, such a spring will be incapable of allowing the window to close by the window pane entering correctly between the weather strips. Indeed, the switching for reversing the movement will take place too early, owing to the weakness of the spring.

In accordance with the invention, the kinematic chain of the window lifter device comprises at least one resilient element for limiting force and damping out a hard impact of the window pane against a hard obstacle, this resilient element being suitable for limiting the force to approximately 100 Newtons.

This or these anti-trapping safety elements, which are, for example, two in number, and suitably positioned, may consist of flat metal springs, or even of elastic blocks, particularly made of rubber or some other material capable of storing up the energy of movement, and of restoring it.

In a window lifter of the type comprising a cable wound around return pulleys and around a drum interacting with the output of the motorized reduction gear, a rail for guiding the cable which can be moved in vertical translation with respect to a door panel, the cable carrying a carriage for supporting the window pane, the resilient damping element may be interposed between the rail and the door panel and fixed to the latter two elements.

For each type of window lifter, the invention therefore makes provision for interposing one or more resilient elements in the kinematic chain in order to damp out the impact of the window pane against a hard object, thus constituting an anti-trapping safety feature preventing a hard impact.

Other features and advantages of the invention will emerge during the description which will follow, given with reference to the appended drawings which illustrate several embodiments thereof by way of non-limiting examples.

Figure 1:
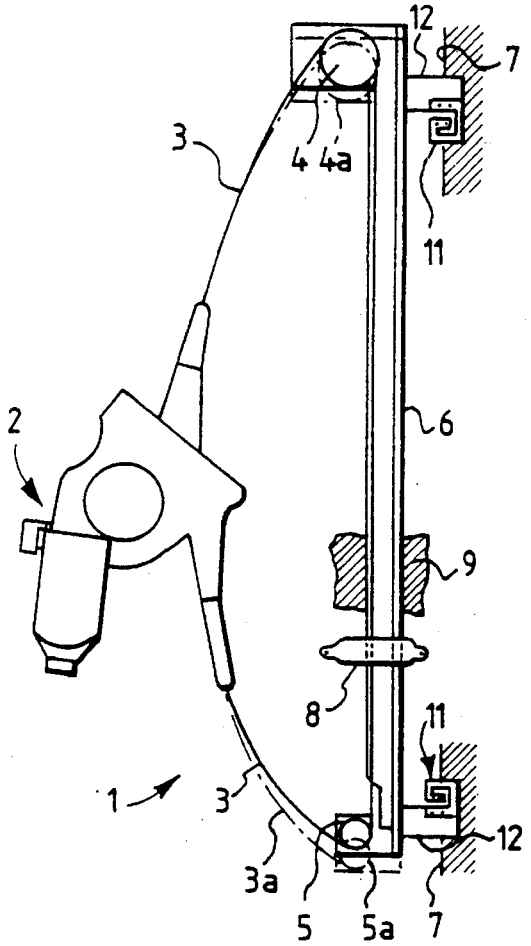
FIG. 1 is a simplified elevation view of a twisted cable type window lifter equipped with damping elements according to a first embodiment of the invention.

The window lifter 1 represented in FIG. 1 comprises a motorized reduction gear 2 for driving a twisted cable or Bowden cable 3 passing over two return pulleys 4, 5. The strand of the cable 3 located between these two pulleys extends along a guide rail 6, mounted so that it can be moved in vertical translation with respect to a door panel 7 which is partially represented.

The cable 3 carries a carriage 8 on which a window pane 9 is mounted. Two resilient damping elements 11 are interposed between the guide rail 6 and the panel 7 and fixed to the latter two elements. In the example represented, each element 11 consists of a flat metal spring having an appropriate curled over configuration, one end of which is fixed by any suitable known means, for example rivets, to a member for connection for the rail 6, such as a tab 12. Its opposite end is fixed, in an appropriate manner which is also known per se, to the door panel 7.

Thus, an impact of the window pane 9 against an obstacle placed in its path is transmitted to the carriage 8, then to the rail 6 and to the window lifter assembly 1, and damped out by the flat springs 11. The latter are subjected to a flexion to which corresponds a movement of the constituent members of the window lifter. This movement has been represented solely for the pulleys 4 and 5 and the cable 3, which come into the position 4*a*, 5*a*, 3*a* represented in chain line, and then return to their initial position under the effect of the elasticity of the springs 11.

Figure 2:
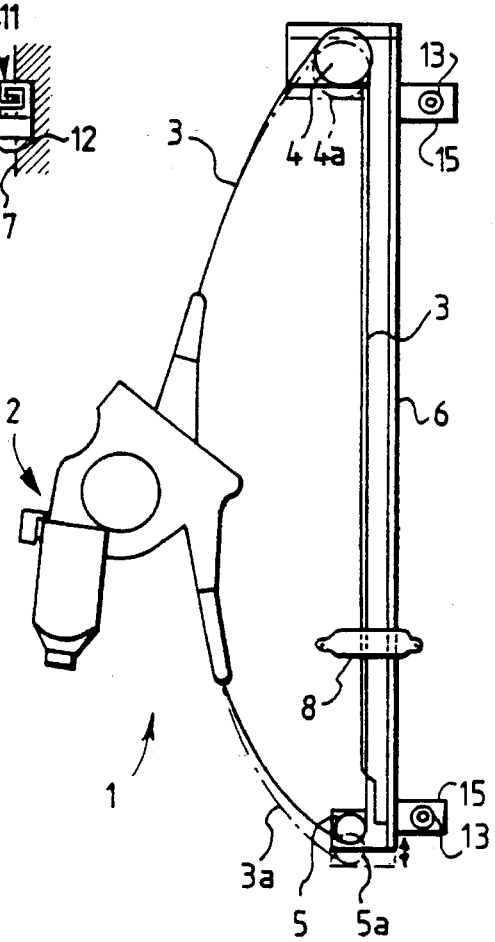
FIG. 2 is a view similar to FIG. 1 of a similar window lifter equipped with damping elements according to a second embodiment of the invention.

The second embodiment, represented in FIG. 2, differs from that of FIG. 1 solely by the fact that the damping elements consist of blocks 13 made from an elastic material, for example rubber ("silent-blocks"). These blocks 13 are mounted suitably, for example slipped over plugs 14 carried by tabs 15 fixed to the rail 6, the end of the plugs 14 opposite the tabs 15 being fixed to the door panel (not represented).

Figure 4:
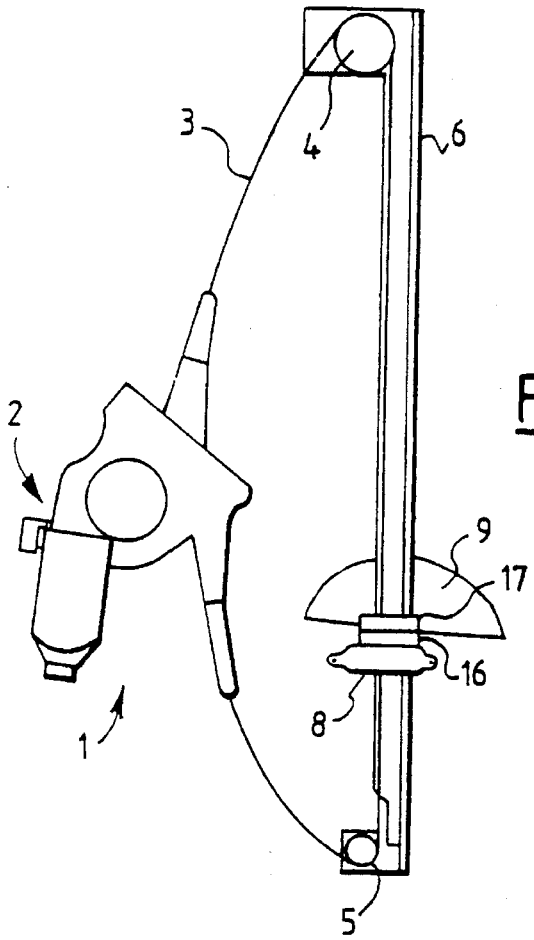
FIGS. 4 and 5 are elevation views of a twisted cable window lifter, these views being similar to those of FIGS. 1 to 3, equipped with a damping element according to two other embodiments of the invention.

In the embodiment of the window lifter 1 of twisted cable 3 type represented in FIG. 4, the damping element 16 is interposed between the carriage 8 and a support 17 for the window pane 9. This damping element 16 is produced from any suitable resilient and elastic material, such as rubber.

Figure 5:
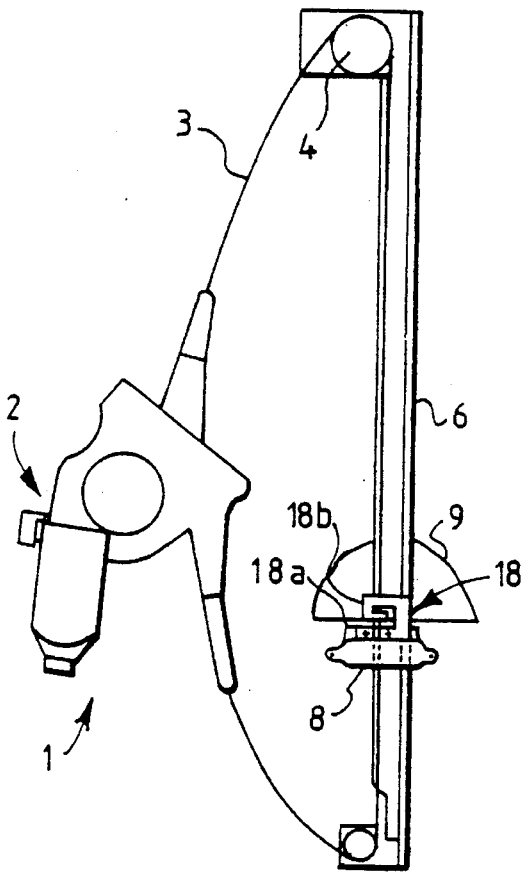
Figure 6:
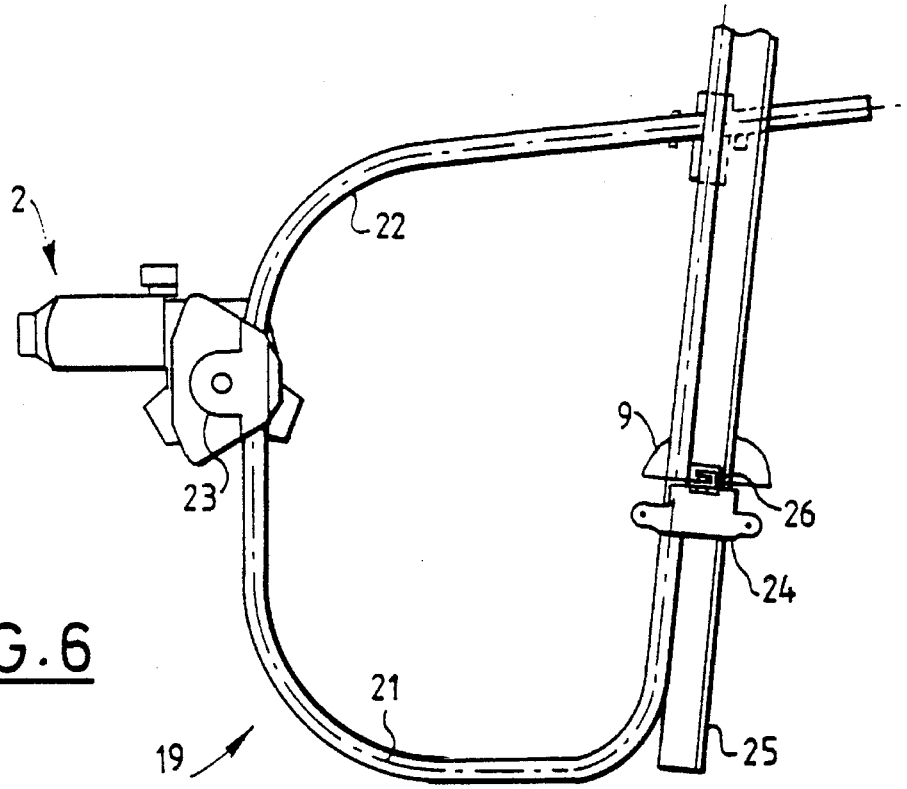
FIGS. 6 and 7 are simplified partial elevation views of the window lifter of the cable rack type associated with a guide rail, equipped with damping elements according to two other embodiments of the invention.

In the variant of FIG. 5, the damping element 18 consists of a flat metal spring similar to the springs 11. This damper 18 is fixed to the carriage 8 by one 18*a* of its two branches, and to the window pane 9 by its second branch 18*b*, by any suitable means known per se.

The window lifter 19 represented in FIGS. 6 to 9 is of the cable rack type 21 sliding in a sheath 22 meshing with an output pinion 23 of the motorized reduction gear 2. A carriage 24 capable of sliding along a substantially vertical guide rail 25 is fixed to the cable 21 and carries the window pane 9. The damping element 26 here is a flat metal spring, similar to the springs 11, fixed on the one hand to the carriage 24 and, on the other hand, to the window pane 9, by means known per se.

Figure 7:
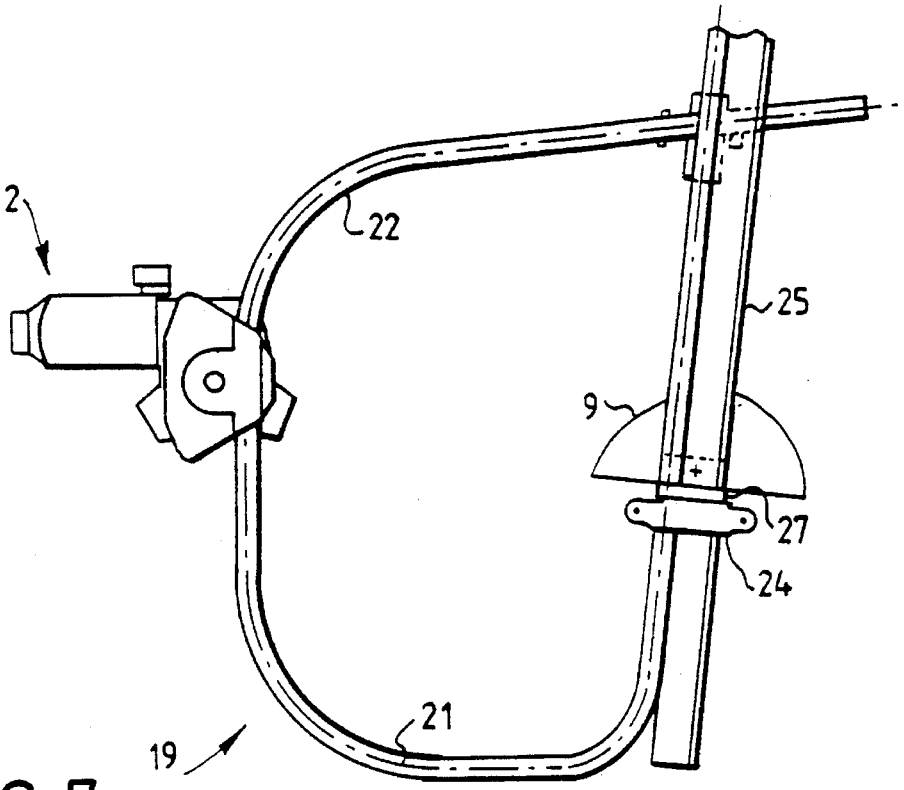

In the variant of FIG. 7, the damper consists of a block 27 of any suitable resilient and elastic material, interposed between the carriage 24 and the window pane 9.

Figure 8:
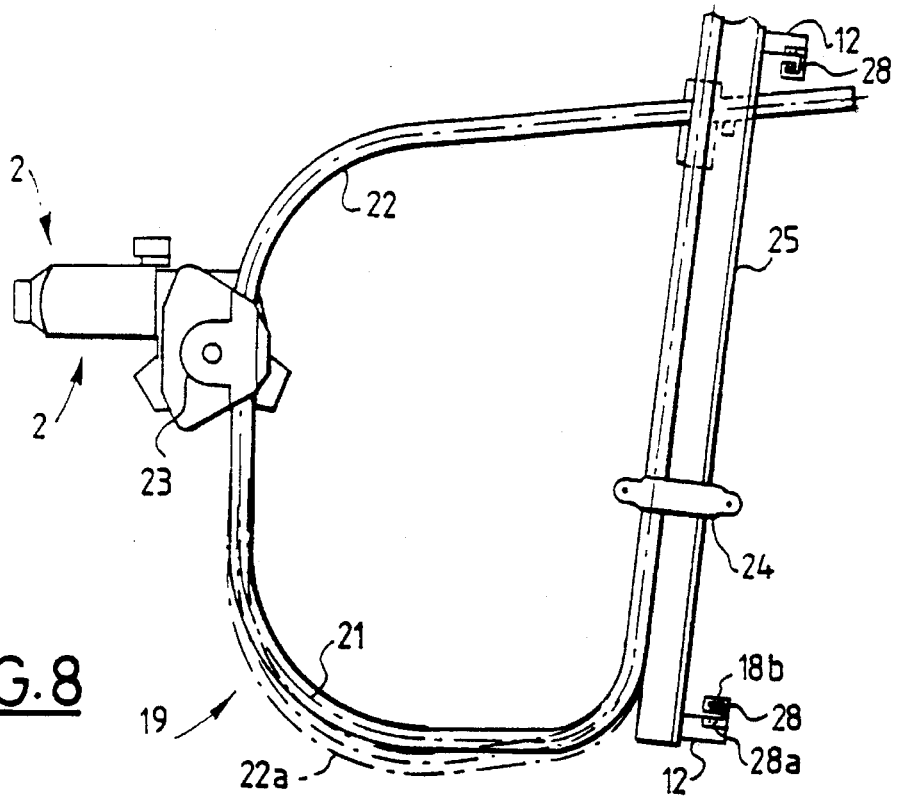
FIGS. 8 and 9 are views similar to FIGS. 6 and 7 representing cable rack window lifters equipped with damping elements according to two other embodiment variants.

According to the embodiment of the window lifter 19 represented in FIG. 8, the damping system consists of two flat springs 28, similar to the springs 11. Like the latter, the springs 28 are mounted on tabs 12 fixed to the rail 25 by one, 28*a*, of their branches, whilst their second branch, 18*b*, is fixed to the door panel (not represented).

Figure 9:
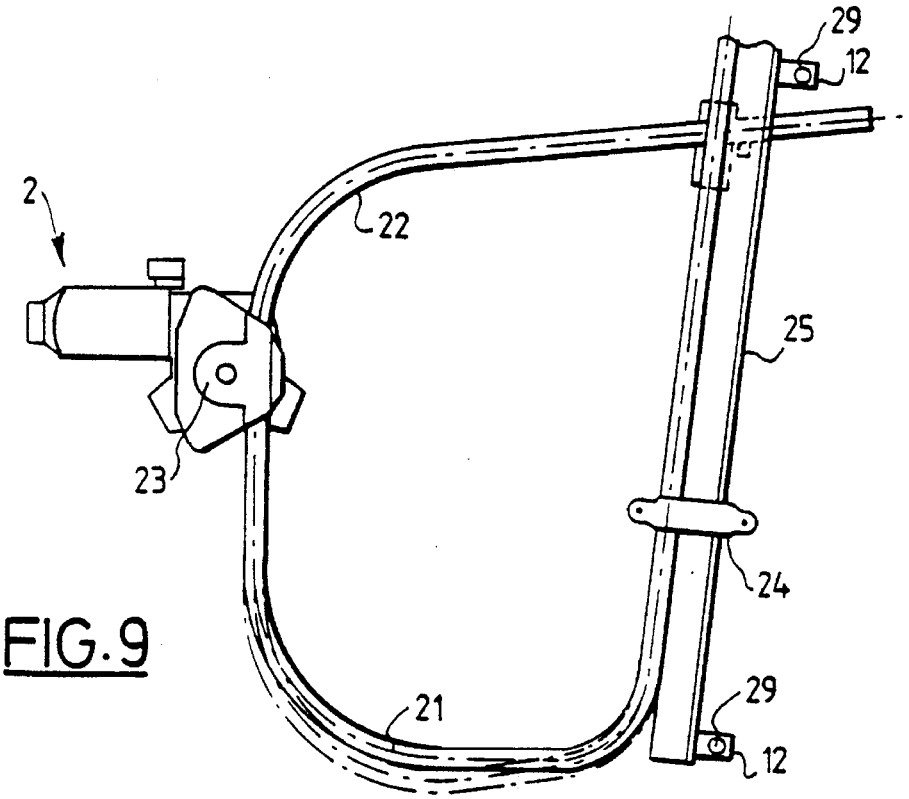

In the variant of FIG. 9, the damping system consists of two elastic blocks 29 similar to the blocks 13 and mounted in the same way as the latter, between the rail 25 and the door panel.

Figure 3:
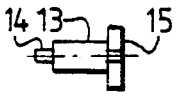
FIG. 3 is a half section half elevation detail view on a larger scale of one of the damping elements of the window lifter of FIG. 2.
Figure 10:
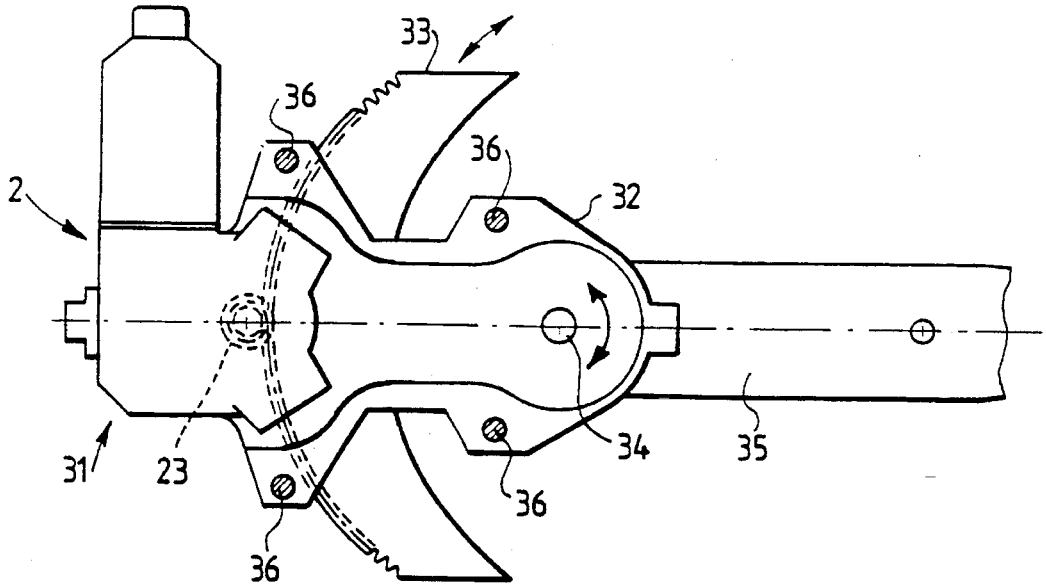
FIGS. 10 and 11 are simplified elevation views of a window lifter of the arm and toothed sector type, equipped with damping elements according to two other embodiments of the invention.
Figure 11:
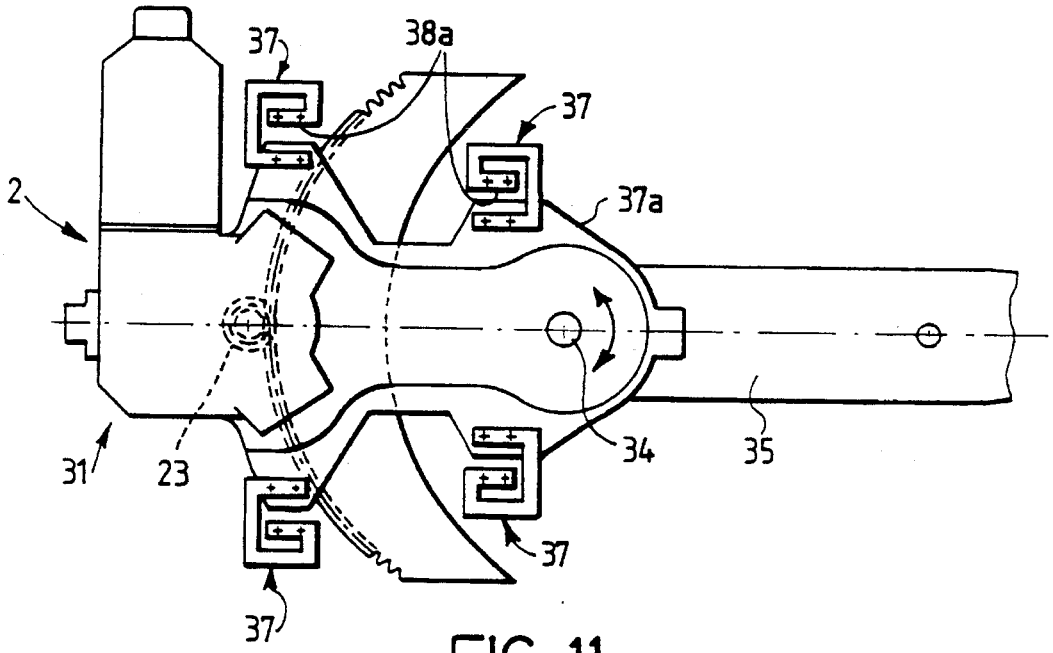

The window lifter 31 illustrated in FIGS. 10 and 11 is of the type with an arm 32 and toothed sector 33 secured to the arm 32, the assembly being mounted so that it can rock about a spindle 34 carried by a fixed plate 35. The toothed sector 33 interacts with the output pinion 23 of the motorized reduction gear 2. The arm 32 is equipped with several resilient damping elements 36, numbering four in the example represented, secured to the support (not represented) of the window pane. The dampers 36 are produced and mounted in the same way as the damping blocks 13, (FIGS. 2 and 3).

In the variant of FIG. 11, the four dampers 36 are replaced by 4 flat metal springs 37, fixed by one, 37*a*, of their branches to the arm 32, and, by the other branch, 38*a*, to the support (not represented) of the window pane.

Figure 12:
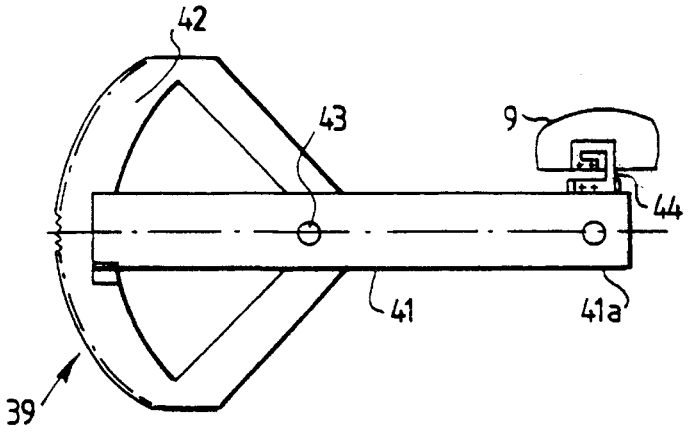
FIGS. 12 and 13 are simplified elevation views of a window lifter of the rocking arm and toothed sector type, each equipped with a damping element in accordance with the invention.
Figure 13:
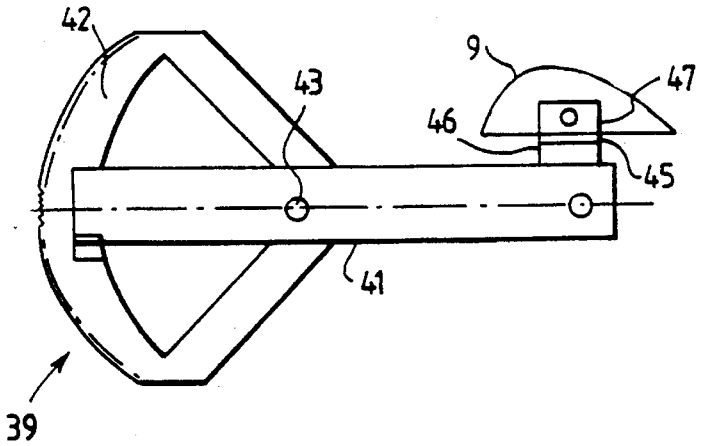

The window lifter 39 illustrated in FIGS. 12 and 13 is of the type having an arm 41 secured to a toothed sector 42 by one of its ends, mounted so that it can rock about a spindle 43 and the opposite end 41a of which carries the window pane 9. A damper 44 consisting of a flat spring similar to those of the other embodiments represented is interposed between the end 41*a* and the window pane 9, and fixed to the latter two elements by any adequate means.

In the variant of FIG. 13, the flat spring 44 is replaced by a resilient block 45 interposed between a base plate 46 secured to the end 41a of the arm 41 and a support 47 of the window pane 9.

Figure 14:
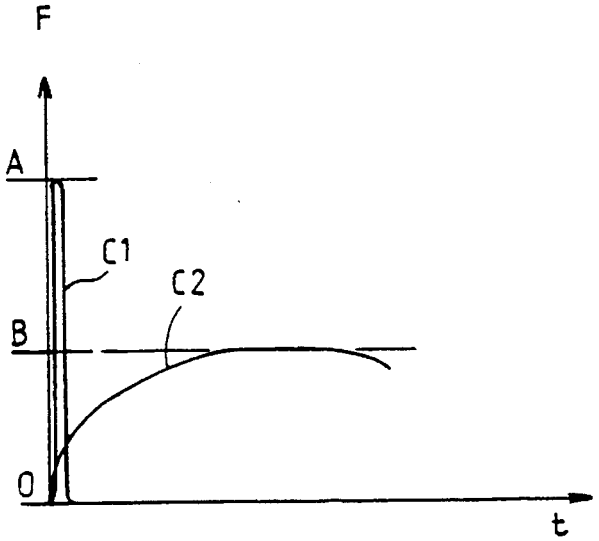
FIG. 14 is a graph illustrating the conversion of a hard impact to a soft impact.

FIG. 14 shows the variation, during an impact, of the force F transmitted by the obstacle, as a function of time t. In the event of a hard impact, the curve C1 is a very sharp peak, of the order of one millisecond, the amplitude A of which may reach enormous and unmeasurable values.

In the case of a soft impact, the curve C2 sees the force rapidly limited to a value B which is low with respect to A, owing to its spread over time t, for example over 10 milliseconds.

The invention is liable to various embodiments, as much as regards the number of damping elements, as their geometric configuration. It is particularly clear that the flat springs may have a very variable geometry, the one represented being supplied solely by way of example. Likewise, any other type of spring, for example a coil spring, may be suitable, if its overall size allows.

I claim:

1. Window lifter device (1; 19; 31, 39) for lifting a window pane (2) with respect to a door panel (7) of a motor vehicle, comprising a motorized reduction gear (2), a kinematic chain being driven by said motorized reduction gear (2), said window pane (9) being mounted at the end of said kinematic chain, means for supporting said window pane (9) with respect to said door panel (7), said means for supporting said window panel (9) with respect to said door panel (7) including at least one resilient element (11; 13; 16 . . .) for limiting force and damping out a hard impact of the window pane against a hard obstacle so as to convert the hard impact to a soft impact, said resilient element being suitable for limiting the force applied to the hard obstacle to approximately 100 Newtons, said motorized reduction gear being generally isolated from the operation of said resilient element.

2. The window lifter device as set forth in claim 1, further comprising a twisted cable (3) wound around return pulleys (4, 5) and around a drum interacting with the output of said motorized reduction gear, a rail (6) for guiding the cable which can be moved in vertical translation with respect to said door panel (7), said cable carrying a carriage (8) for supporting said window pane, said resilient element (11; 13) being interposed between said rail and said door panel and being fixed to said door panel.

3. The window lifter device as set forth in claim 1, further comprising a twisted cable (3) wound around return pulleys (4, 5) and around a drum interacting with the output of said motorized reduction gear, a rail (6) for guiding the cable which can move in vertical translation with respect to said door panel (7), said cable carrying a carriage (8) for supporting said window pane, a support (17) for supporting said window pane with respect to said carriage said resilient element (16) being interposed between said carriage (8) and said support (17) of the window pane (9).

4. The window lifter device as set forth in claim 1 further comprising a rack cable (21) sliding in a sheath (22) meshing with an output pinion (23) of said motorized reduction gear (2), a carriage (24) carrying said window pane (9) being fixed to the cable and capable of sliding along a guide rail (25), said resilient damping element (26; 27) being interposed between said carriage and said window pane.

5. The window lifter device as set forth in claim 1, further comprising a rack cable (21) sliding in a sheath (22), meshing with an output pinion (23) of said motorized reduction gear (2), a carriage (24) carrying said window pane (9) being fixed to the cable and capable of sliding along a guide rail (25), said resilient damping element (28) being interposed between said guide rail (25) and said door panel and being secured to said door panel.

6. The window lifter device as set forth in claim 1, characterized in that said resilient element is an elastic block (13; 16; 36).

7. The window lifter device as set forth in claim 1, characterized in that the resilient element is a spring.

8. A window lifter device for vertically translating a window pane with respect to a door panel, said window lifter device comprising:

a motorized reduction gear;

a kinematic chain being driven by said motorized reduction gear, said kinematic chain having an end at which said window pane is mounted;

means for supporting said window pane with respect to said door panel;

said means for supporting said window pane with respect to said door panel including a resilient element being operable to damp impact of said window pane with respect to an obstacle; and said motorized reduction gear being generally isolated from the operation of said resilient element.

9. The window lifter device according to claim 8, wherein said means for supporting said window pane includes a rail being operable to guide movement of said window pane, said resilient element being disposed between said rail and said door panel.

10. The window lifter device according to claim 8, wherein said means for supporting said window pane includes a carriage for raising said window pane and a support operable to provide support for said window pane, said resilient element being disposed between said carriage and so support.

11. The window lifter device according to claim 8 further comprising a carriage which is operable to provide support for said window pane, said resilient elements being disposed between said window pane and said carriage.

12. The window lifter device according to claim 8, wherein said resilient element is an elastic block.

13. The window lifter device according to claim 8, wherein said resilient element is a flat metal spring.

14. A window lifter device for vertically translating a window pane with respect to a door panel, said window lifter device comprising:

a motorized reduction gear;

a kinematic chain being driven by said motorized reduction gear, said kinematic chain having an end at which said window pane is mounted;

means for supporting said window pane with respect to said door panel;

said means for supporting said window pane with respect to said door panel including a resilient element being operable to damp impact of said window pane with respect to an obstacle; and said motorized reduction gear being generally isolated from the operation of said resilient element, whereby said resilient element is operable to damp out a hard impact of the window pane against an obstacle so as to convert the hard impact into a soft impact, said resilient element being further operable to limit the force applied by the window pane to the obstacle to approximately 100 Newtons.

15. The window lifter device according to claim 14, wherein said means for supporting said window pane includes a rail being operable to guide movement of said window pane, said resilient element being disposed between disposed between said rail and said door panel.

16. The window lifter device according to claim 14, wherein said means for supporting said window pane includes a carriage for raising said window pane and a support operable to provide support for said window pane, said resilient element being disposed between said carriage and said support.

17. The window lifter device according to claim 14, further comprising a carriage which is operable to provide support for said window pane, said resilient element being disposed between said window pane and said carriage.

18. The window lifter device according to claim 14, wherein said resilient element is an elastic block.

19. The window lifter device according to claim 14, wherein said resilient element is a flat metal spring.

* * * * *